United States Patent [19]

Karpisek

[11] Patent Number: 5,002,202

[45] Date of Patent: Mar. 26, 1991

[54] BAG PUNCTURING MEANS

[76] Inventor: Ladislav S. Karpisek, 86 Woodfield Boulevarde, Caringbah, New South Wales, 2229, Australia

[21] Appl. No.: 400,157

[22] Filed: Aug. 29, 1989

[30] Foreign Application Priority Data

Sep. 7, 1988 [AU] Australia ..... PJ0293

[51] Int. Cl.[5] ..... B65D 47/36

[52] U.S. Cl. ..... 222/83; 222/91

[58] Field of Search ..... 222/81, 83, 89, 91, 222/105, 564

[56] References Cited

U.S. PATENT DOCUMENTS

| | | | |
|---|---|---|---|
| 1,380,062 | 5/1921 | Heffernan | 222/91 |
| 1,664,796 | 4/1928 | Spangle | 222/91 X |
| 2,526,708 | 10/1950 | Sundholm | 222/89 X |
| 3,206,075 | 9/1965 | Scholle | 222/105 |
| 3,239,104 | 3/1966 | Scholle | 222/89 X |
| 3,995,773 | 12/1976 | Schmit | 222/91 |
| 4,138,036 | 2/1979 | Bond | 222/105 |
| 4,475,670 | 10/1984 | Rutter | 222/91 X |

FOREIGN PATENT DOCUMENTS

| | | | |
|---|---|---|---|
| 2182320 | 5/1987 | United Kingdom | 222/91 |

*Primary Examiner*—Andres Kashnikow
*Assistant Examiner*—William Grant
*Attorney, Agent, or Firm*—Edwin D. Schindler

[57] ABSTRACT

A bag puncturing device to couple to a socket outlet of a plastic liner bag of a liquid container where the socket is closed off by a portion of the plastic bag. The puncturing device comprises a connector engagable in the socket and movable linearly in the socket and having a liquid passing opening through the connector housing a coiled compression spring which extends from the connector and is longer than the socket and a cutter which is caused to penetrate the socket closing portion of the bag by relative movement between the connector and the socket thereby allowing the spring to enter into the bag.

4 Claims, 1 Drawing Sheet

FIG. 1.
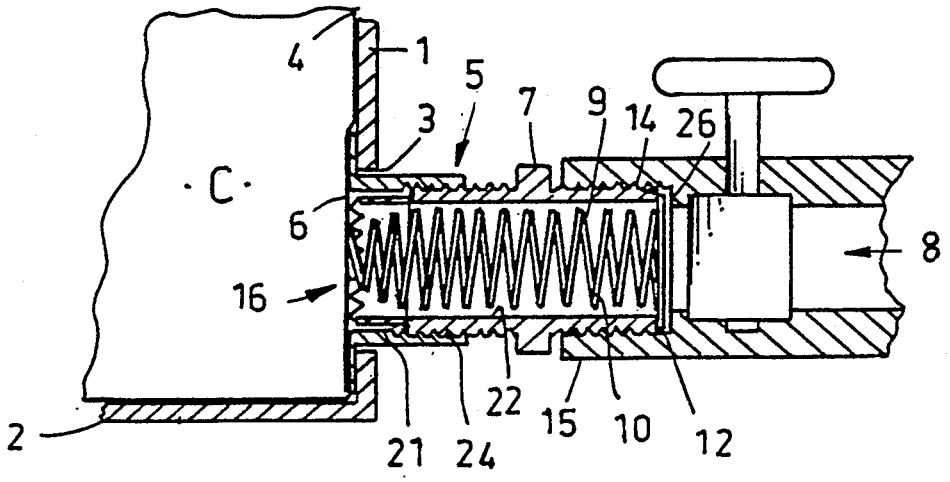
FIG. 2.
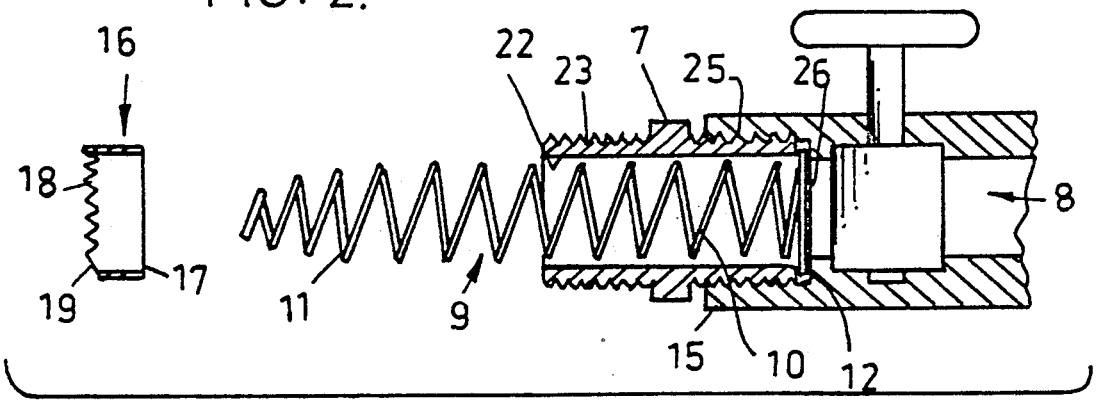
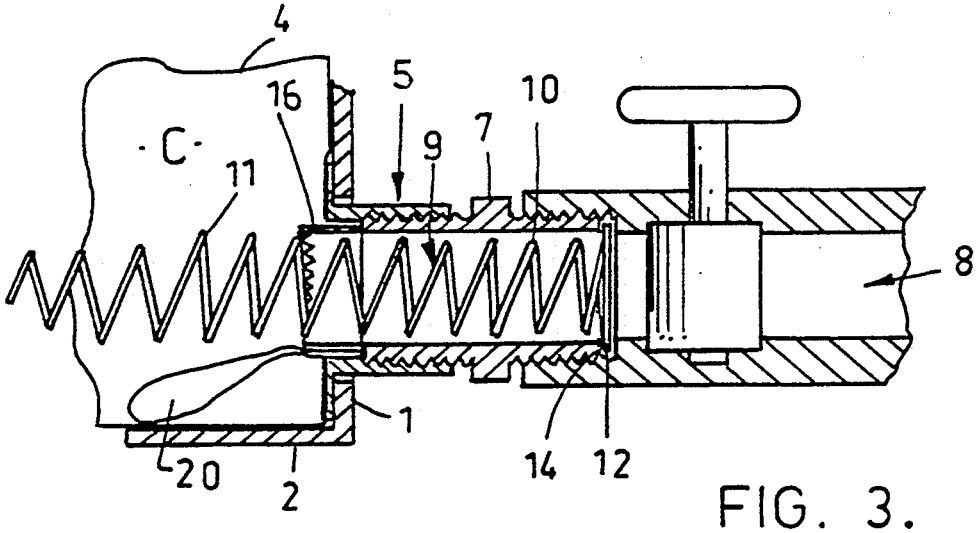
FIG. 3.

BAG PUNCTURING MEANS

This invention is concerned with apparatus used in the discharge of liquid from a container.

It is common practice to transport liquids in a rigid container lined with a plastic liquid impervious bag. The container includes a side discharge port near the bottom of one side and a discharge means is mounted in the discharge port and the plastic bag is punctured to allow the contents to flow from the liner bag through the discharge means.

It has been found that when the liquid level is close to the bottom of a container during a discharge operation it is not uncommon for the plastic around the punture in the liner bag to enter the puncture hole and this can interrupt the free flow of liquid from the liner bag. In some instances there is a total interruption of flow making it almost impossible to completely discharge the liquid.

An object of the present invention is to overcome the above problem by providing a device to puncture the plastic liner bag without completely severing a piece of the plastic bag and to prevent the plastic bag adjacent the puncture and the plastic displaced by the puncturing operation from entering the discharge hole from the bag.

Broadly, the invention can be said to provide a bag puncturing means to form a hole in a liquid filled plastic bag housed in a rigid container and having a socket means extending through a wall of the container with a socket bore providing access to a portion of the bag to be punctured and adapted to be engaged by said puncturing means; said puncturing means comprising a connector with a bore extending through said connector, coupling means to couple said connector and said socket means with the bores of the connector and the socket means in communication, said coupling means allowing linear relative movement between said connector and the socket means and a compressible coil spring mounted in said connector bore and fixed to and movable with said connector with a portion of said spring extending from said connector bore, the length of said spring portion being such that when in an uncompressed state with the connector coupled to said socket means at least a part of said portion adjacent a free end of said portion would extend into the interior of said bag when punctured, and an aperture forming means to penetrate said bag portion as said connector is moved linearly relative to the socket means in a bag puncturing direction.

Two presently preferred forms of the invention will now be described with reference to the accompanying drawings in which;

FIG. 1 is a fragmentary sectional elevation of a first form of the puncturing means of the present invention mounted in a container prior to the formation of a liquid releasing aperture in the bag, FIG. 2 is an exploded sectional view of the several parts of the puncturing means of FIG. 1, and FIG. 3 is a view similar to FIG. 1 where the bag has been punctured.

In the drawing FIGS. 1 and 3 there is shown a fragment of a container C having a rigid front wall 1 and a rigid base 2 and an opening 3 in the wall 1. Within the container represented by the wall 1 and the bottom 2 there is a plastic liner bag 4 with an internally threaded socket 5 welded to the bag 4 and aligned with the bore 21 of the socket 5 there is a portion of the bag wall identified 6 which is intended to be punctured to allow the liquid to discharge from the bag. The socket 5 projects through the opening 3 in the container wall 1.

The manner of bag construction can be varied according to requirements but the final product is as illustrated, namely, there is a socket adapted to receive a threaded connection piece whereby the socket is coupled to a discharge means, such as a hose or a pipe or a valve. There is a portion 6 intended to be punctured in some manner and the liquid in the bag discharges through the socket.

The puncturing means has as essential components a connector which is, as illustrated, a nipple member 7 threaded at both ends at 23 and 25 which ends are respectively adapted to enter into the threaded part 24 of the bore 21 of the socket 5 and into a valve 8. Housed within the nipple member 7 there is a compressible coil spring 9 which preferably has a particular shape, see FIGS. 2 and 3. The spring shape includes a parallel portion 10 and a tapered portion 11 at one end. At the other end the spring has an enlarged end coil 12 which, as will be seen from FIG. 2, is intended to be retained (or locked if desired) between the end 14 of the nipple 7 and the shoulder 26 at the bottom of the internally threaded connection end 15 of the valve 8.

There is a cutter 16, which has a ring or tubular form with a flat end 17 and teeth 18 at the other end. It is to be noted however that the teeth 18 do not extend the whole way around the cutter and there is a non-toothed portion indicated 19 without teeth and at a lower level than the tops of the teeth 18. The outside diameter of the cutter 16 is greater than the diameter of the bore 22 of the nipple but less than the outside diameter of the threaded part 23 of the nipple.

From FIG. 1 it will be seen that as the connector nipple 7 is threaded into the socket 5 the spring 9 is compressed as it bears against the bag portion 6. Further threading engagement of the connector into the socket brings the teeth 18 of the cutter 16 into engagement with the bag portion 6 and puncturing occurs. The development of the puncture is by the points of the teeth penetrating the bag and as the cutter is forced further into the bag the penetrations extend into slits which eventually join up. Prior to the slits joining up the pressure exerted by the compressed spring will usually overcome the resistance of the uncut plastic bag between the slits and a flap 20 is forced into the interior of the bag. For convenience the flap 20 is shown at the bottom of the hole, in practice the flap 20 could be anywhere around the circumference of the cutter.

As will be seen from FIG. 3 the spring, which has a length uncompressed such that is will extend into the bag, prevents the flap 20 from being drawn back into the socket as the liquid discharges and thus the object of the invention is achieved.

When the nipple is withdrawn the spring is withdrawn, because of the coil 12 held captive between the nipple and valve. The cutter supported on the spring will be withdrawn at the same time and the cutter will be supported by the spring as it is withdrawn from the bore 21 of the socket 5.

In an alternative arrangement, there is no cutter 16 and the spring is substantially the same diameter along its length, except for the enlarged end coil 12 which is, as before, captive between the nipple and the valve. The free end of the spring is a "flattened" coil with an upstanding sharpened spur. As the nipple is threaded into the spout the spring is compressed but at the same time it is forceably rotated with the nipple. The rotation causes the spur to cut through the bag portion 6 and eventually there is sufficient of the portion 6 slit to allow the compressed spring to burst therethrough to push a flap 20 aside. It will be understood that total severance would not occur because, as before, once there has been sufficient partial severance the spring will push the flap 20 aside and enter the liner bag.

The presently preferred two embodiment of the invention as just described are representative of two possible manners of introducing a flap restrainer into a liquid containing bag and are not to be construed as the only ways in which this objective is able to be achieved.

I claim:

1. Bag puncturing means for use with a liquid filled plastic bag housed in a rigid container and having a socket extending through a wall of the container, thread means on the socket capable of allowing the bag puncturing means to be mountable on and removed from the socket and a cutter receiving bore in the socket occluded by the plastic of said bag, said bag puncturing means comprising:

a connector having a bore therethrough;

thread means on the connector for allowing the connector to be coupled to and moved both rotationally and linearly relative to a bag socket having a bore;

a tubular cutter with an external dimension which is greater than that of the bore of the connector and less than that of the bore of the bag socket in which said tubular cutter is to operate, said cutter being movable linearly without substantial rotation in the bore of the bag socket as a result of rotational movement of said connector;

a continuous row of bag piercing teeth extending around less than the entirety of one end of the tubular cutter;

compressible spring housed in the bore of the connector and extending beyond one end of the connector and through the cutter with a first, free end of the spring beyond said one end of the tubular cutter when the tubular cutter and the connector are in an end-to-end working relationship and the spring is uncompressed;

spring retaining means for holding the spring captive to the connector by a second end of the spring, said spring being compressible to a condition wherein the first, free end of the spring is capable of lying within the tubular cutter.

2. The bag puncturing means as claimed in claim 1, wherein said row of teeth includes alternating peaks and valleys and that a part of said one end of said tubular cutter not having teeth lies at an elevation lower than the peaks of said teeth.

3. The bag puncturing means as claimed in claim 1, further comprising coupling means for coupling a valve to said connector for regulating a flow of liquid through the bore of said connector.

4. The bag puncturing means as claimed in claim 3, further comprising valve mounting thread means on said connector adjacent a second end of said connector, a valve having an inlet bore, thread means on the valve for engaging with the valve mounting thread means on said connector, a shoulder in the inlet bore of the valve with said spring retaining means comprising an enlarged coil at said second end of the spring with the enlarged coil being disposed in a gap between said valve shoulder and said second end of said connector.

* * * * *